US007090198B1

(12) United States Patent
Gurmu

(10) Patent No.: US 7,090,198 B1
(45) Date of Patent: Aug. 15, 2006

(54) MAGNETIC STAPLE REMOVER

(75) Inventor: Michael Gurmu, Oakland, CA (US)

(73) Assignee: Genet Michael, Oakland, CA (US)

( * ) Notice: Subject to any disclaimer, the term of this patent is extended or adjusted under 35 U.S.C. 154(b) by 0 days.

(21) Appl. No.: 11/341,680

(22) Filed: Jan. 30, 2006

(51) Int. Cl.
*B25C 11/00* (2006.01)

(52) U.S. Cl. ..... 254/28

(58) Field of Classification Search ..... 254/28, 254/8

See application file for complete search history.

(56) References Cited

U.S. PATENT DOCUMENTS 4,054,263 A * 10/1977 Delia ..... 254/28
4,784,370 A 11/1988 Strickland
5,513,833 A * 5/1996 Kirk ..... 254/28
5,657,965 A * 8/1997 Arias ..... 254/28
5,957,430 A 9/1999 Olson
6,641,114 B1 11/2003 Davis
2005/0056817 A1* 3/2005 Lee ..... 254/28

* cited by examiner

*Primary Examiner*—Lee D. Wilson

(57) ABSTRACT

The staple remover includes a large and small arm cooperating to withdraw staples. The larger arm includes at a working end a pair of prongs between which is centered a single prong provided at a working end of the smaller arm. The prongs include curved camming surfaces extending from arm working ends toward their pivoted ends. Arms are interconnected at their pivoted ends so as to be opened and closed for cooperation when removing bound staples. The camming surface of the single prong of smaller arm is shorter than the camming surfaces of the prongs of the larger arm such that a staple will be deformed and discarded rather than clinging to remover prongs. Included within the arms is a collection box with a magnetized plate or drawer positioned for capturing the discarded staples. An opening in the collection box permits removal of the plate for crushed staple disposal.

8 Claims, 5 Drawing Sheets

MAGNETIC STAPLE REMOVER

CROSS REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

The present invention relates to the field of hand tools, and more specifically to hand-wielded implements for removing bound staples from stapled documents or other layered materials.

Fastening and unfastening layered document pages and the like have long been necessary tasks in both business and residential settings. A century ago, such work was delegated to sturdy, sharply pointed pins somewhat more substantial than a florist's stick pins and tailor's straight pins currently in use. Document pins generally were elongated with one end bent into a T-shape or L-configuration so as to provide a blunt pushing surface. With one hand, usually employing a bare thumb or other finger, a user would press against the blunt pushing surface so as to puncture through layered documents from a front side to a backside thereof. Next, using bare fingers of the other hand, the pin would be pressed and forcibly redirected for a return pass entirely through the layered document, thus delivering its sharp point exit at the front of the layers.

The result would be that the document pages would be snuggly secured, although a clearly hazardous pin point would remain conspicuously exposed. Injuries from this practice and from its hazardous result were common, often to the extent that bloodstains on the fastened documents were not uncommon.

In subsequent years, mechanical staplers were developed, thus putting an end to the hazardous pinning method. The most common staple design continues to be a segment of wire configured so as to have two short, generally parallel legs interconnected by a slightly longer wire bridge. Often the staple legs are sharpened at their tips. These staples are loaded into a stapling machine and dispensed manually or mechanically on demand.

Table model staplers were popular for decades, performing as static stapling stations. These were soon joined by small, portable (non-static) hand-wielded versions that would be moved to the stapling target. More recently, stapling has most often been performed automatically by auxiliary stapling units mounted on high volume photocopiers. Stapling technology has made great advancement while the staples themselves have seen little or no change. While stapling techniques have become safer and more efficient, staple-related injuries have continued, especially during un-stapling (staple removal) efforts.

Staple pulling since early times continues to be a manual effort. Staple removal implements ranged from a user's thumbnails to a handy pocketknife or letter opener. Of course, these techniques induced injuries, as well. In the relatively recent past, specialty hand tools have been developed for removing staples. Custom staple-pullers are presented either as an integral feature of handheld staplers or more frequently as standalone devices.

Handheld staple removers are available in various designs. Most common are the hand powered variety, often including either a wedging blade or cooperative prong elements to spread and lift the staple. Single blade staple removers are often constructed by machining, casting, or forging metal into a blade sized for insertion beneath a staple bridge portion. The blade may be progressively narrower at its leading tip so that its movement under the staple bridge serves to slightly lift the staple bridge and then to push it away from the document layers in a camming action, thus unbending and extracting the staple legs.

Jaw type extractors or pullers with opposed prongs or tips extending from a common hinge are also shaped such that they effectively narrow toward their tips so that their insertion beneath the staple bridge initially lifts the bridge slightly, then pushes and spreads it away in a camming action so as to unbend and extract the staple legs. Hence, the staple is essentially pushed or wedged out of its fixed engagement. With either tool, blade or jaw type, the removed staples will remain jammed upon the remover blade or jaw tips, or they simply take flight.

So, while advancements in stapling technology have all but eliminated the hazards involved in fastening pages or other materials together, there have been no effective improvements in the manual staple removal process, particularly since the removed staples must ultimately be manually handled and disposed of one-at-a-time. The most exasperating issue is that the removed staples too often are left scattered on workspace desks, tables, and carpets, or tenaciously wedged on the staple remover itself. These used staples remain as sharp as when first applied, ready to wreak injury to the user's hands or clothing.

The broken, jammed or clinging staple can cause painful damage to the user's fingers and to the device itself, as well as to the documents or materials to which the staple is attached. Yet another problem with the currently available models is that they do not provide an efficient or effective built-in-storage facility for the removed staples. This results in a littering of the workplace and a menace to both the cleaning staff and the vacuum cleaners.

The prior art reflects a number of inventions developed to address some of these problems. For example, U.S. Pat. No. 5,957,430, issued on Sep. 28, 1999, to Olson, provides magnetic areas on the outside of a four-pronged staple remover, presumably to catch the ejected staple if it happens to land on one of the magnetic areas. However, there is some doubt as to the effectiveness of the Olson device. If the removed staple frees itself from clinging onto the large arm of the Olson device and does not land on the designated magnetic areas, it can fly out in any direction away from the magnets. Thus the primary problem—breaking, jamming, and clinging staples, as well as a lack of proper storage means—remains to be addressed.

U.S. Pat. No. 4,784,370, issued on Nov. 15, 1988, to Strickland provides a staple remover with a unique clamp for removing a broken staple. The Strickland concept appears reasonable in theory, but in practice problems continue to exist with respect to clinging staples and a lack of a storage facility for the removed staples.

U.S. Pat. No. 6,641,114B1 to Carmen, while disclosing an attractive round-bodied staple remover, does not address how the user will be able to view the staple and insert the teeth of the remover underneath the staple to successfully remove it from papers to which it is attached. For the user of the round-bodied staple remover, it is important that he/she sees that the teeth of the remover fit between the two legs of the staple without any guesswork. Thus, not only are the problems of broken, jammed, clinging and flying staples not addressed by Carmen, another problem is introduced by blocking the user's line of sight.

Thus, all conventional type staple removers that have two teeth/prongs on each of a pair of cooperating arms (where one of said cooperating arms is larger than the other) have at least three inherent problems: (1) the breaking of the staple while being removed; (2) the jamming of one leg of the staple in the papers, while being removed, and (3) the clinging of the staple onto the larger arm of the device.

The first two problems occur because the smaller of the cooperating arms of the staple remover (as in currently available models) is not always evenly centered within the receiving chamber of the larger arm (i.e., between puller prongs of the larger arm). The third problem occurs because of the length of the camming surface area of currently available models. On these conventional models, the camming area begins at the tip of the teeth/prongs and extends all the way to the chamber area. This kind of construction does not allow the removed staple to fall free into a channel section of the large arm, so it thus remains clinging on an arm of the staple remover.

Therefore, while numerous staple puller models have been introduced in the past, they all display the aforementioned design flaws and are thus unable to address the practical problems solved by the present invention. The present invention is based on the ideal of preventing problems before they occur, and it is designed in such a way that it prevents the aforementioned inherent problems of the conventional type staple removers currently in use. The inventive construction proposed herein is new and novel.

Accordingly, it is the primary object of the present invention to provide a staple remover that removes the staple without breaking it into pieces. It is a further principal object of the present invention to provide a staple remover that successfully removes staples without allowing them to cling to the papers or to the arms of the staple remover itself.

It is also an object of the present invention to provide a box (shield) to prevent staples from escaping and littering the work area (and from endangering the user's eyes, hands, toes, etc.). It is still another object of the present invention to provide a shorter camming surface area in order to allow the removed staple to fall or be projected into a collector box area without clinging to the a remover arm.

Another object of the present invention is to provide a tray or drawer with a magnetic surface or magnetized portions that catch and collect removed staples for later removal and disposal, for example by withdrawing the tray through a convenient housing opening. A further object of the present invention is to crush or otherwise deform removed staples into different shapes and sizes in order to avoid having removed staples clinging to the papers or the staple remover's arms.

A further object of the present invention to enhance productivity and safety on the part of both the end-user and cleaning staffs of organizations (where applicable). Finally, it is an object of the present invention to create a staple remover that requires simple material and minimal labor, and that can easily be produced in a cost effective manner.

These and other objects of the present invention can be seen in detail by referring to the following specifications and technical drawings.

SUMMARY OF THE INVENTION

Removed staples are known to litter desk areas, computer keyboards, printers and floors. Particularly when staples get jammed into carpets, it is found to be a time consuming and costly process to remove them. According to surveyed office managers, it is well known that many labor hours are spent on this task. Besides that, staples embedded in carpets can spring up and damage a person's skin or eyes. The present invention overcomes these problems by providing a staple remover that minimizes the size of the removed staple by compressing and deforming it, enabling it to fall or be projected into a boxed area with a magnetic lining or tray to retain the staples until they can be fully discarded for disposal.

In the present invention, the staple remover has two arms, namely a smaller arm and a larger arm, pivotally joined together at rear, hinged ends remote from their forward, working ends. The smaller (narrow) arm is constructed to include a channel section, a box section, and a single prong section at its forward or working end. The larger (wide) arm is constructed to include a channel section, a box section and a two-pronged section at its forward or working end.

The larger and smaller arms are attached together at their rear or pivoted ends, at a location remote from said forward working ends. To facilitate a pivoting action the arms are commonly mounted on a pin and spring mechanism biasing separation of the two arms. The present inventive staple remover can be fabricated from metal, wood or hard plastic, or a combination of at least two of these.

When pulling a staple from stapled layers, the dual prongs of the large arm and the single prong of the small arm are forced beneath the staple from opposite sides. The single prong moves between the dual prongs, while the opposing prongs cooperate in lifting the staple. Once the staple is lifted slightly, the forcing action of the single prong changes from a pulling into a pushing force. Since the single prong of the smaller arm has a camming surface shorter in extent as compared to the camming surfaces of the dual prongs on the larger arm, the pushing force acts to crush the pulled staple as it is moved into the boxed area for magnetized collection within the larger arm.

As crushing occurs, the removed staple will have its form altered from its initial squared form into a rounded "U" or angular "V" or other disfiguring compressed shape resulting in a smaller size. The crushed staple can then easily project onto the magnetized surface of a tray or drawer in the large box of the large arm. The light magnetic surface of the tray will accumulate removed staples until they are retrieved by the user for placement into a trashcan.

BRIEF SUMMARY OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. For a more comprehensive understanding of the invention, please refer to the accompanying illustrations as follows.

DRAWINGS—REFERENCE NUMERALS

Figure 1:
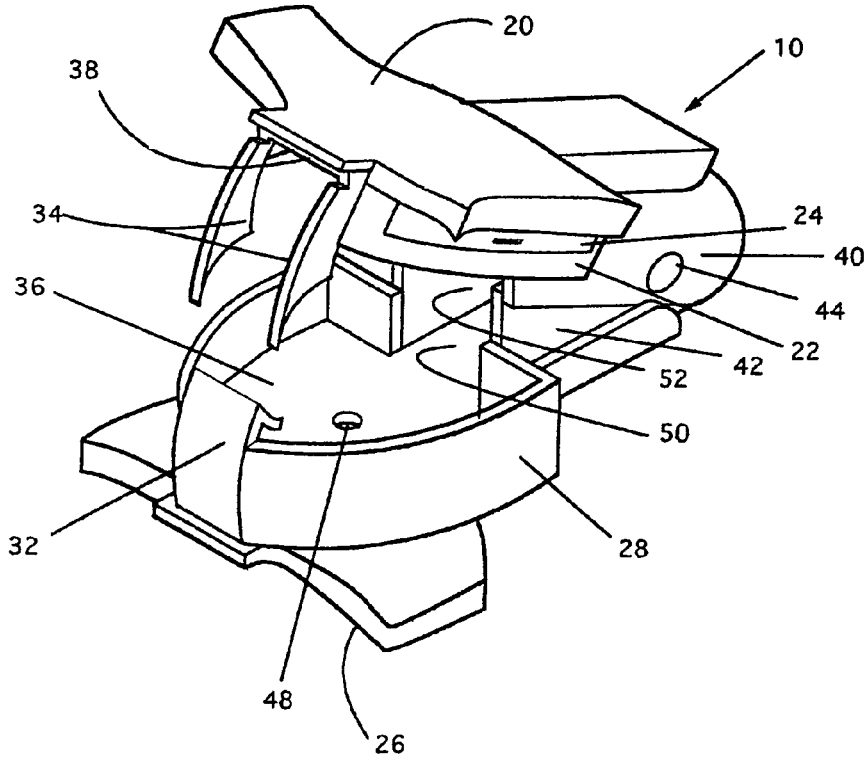
FIG. 1 shows a perspective view of the present invention.

The following is a listing of parts as identified by reference characters found in the drawing figures:

(20) Thumb/finger grip area of the larger arm
(22) Large box of larger arm
(24) Magnetized tray or drawer
(26) Thumb/finger grip area of the smaller arm
(28) Small box of the smaller arm
(30) Pivot Pin
(32) Single prong of the smaller arm
(34) Prongs of the larger arm
(36) Lower surface plate portions of smaller arm box
(38) Upper surface plate portions of larger arm box
(40) Larger arm
(42) Smaller arm
(44) Hinge Pin Hole
(46) Rivet holes where larger arm is to be riveted to large box
(48) Rivet holes where smaller arm is to be riveted to small box
(50) Channel section of the small arm
(52) Channel section of the large arm
(54) Spring
(56) Camming surface of the large prongs
(58) Camming surface of the single prong

DETAILED DESCRIPTION OF THE INVENTION

Figure 2:
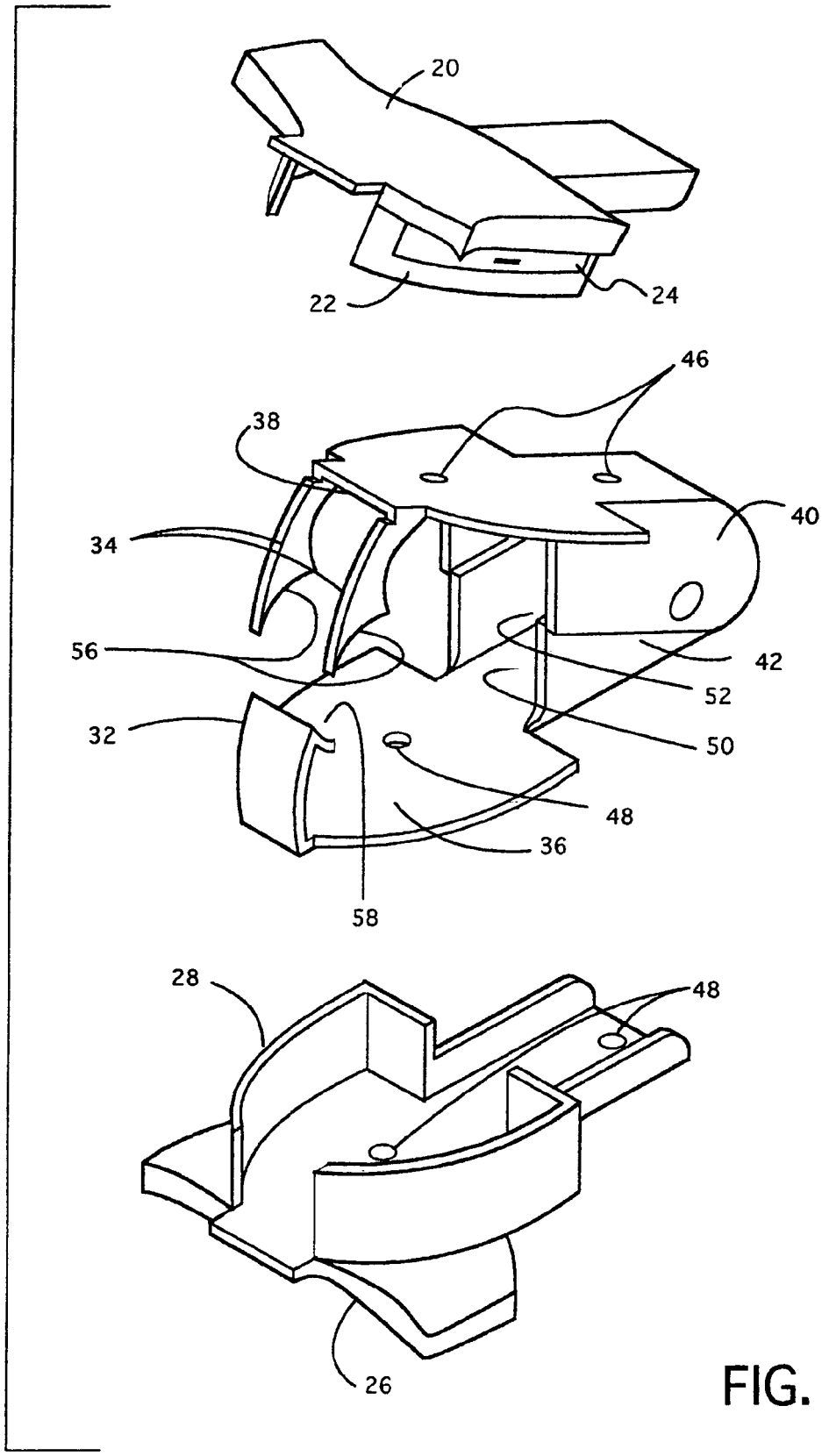
FIG. 2 is an exploded view of the present invention.

The staple remover of the present invention is illustrated in FIGS. 1–7. FIG. 1 is a perspective view of the subject invention generally identified at 10. FIG. 2 is an exploded view (shown as a bracketed view) of the subject invention 10 for more clarity and ease of description. The inventive staple remover 10 is illustrated as comprising a pair of cooperating arms, 40 and 42. More specifically, these arms include a larger arm 40 and a smaller arm 42, having working ends in the form of a pair of staple pulling prongs 34 (part of arm 40) defining a space therebetween as shown in FIG. 1, and a single staple pulling prong 32 (part of arm 42) having a single engaging edge sized to extend across said space between the pair of prongs 34.

Larger arm 40 is fabricated such that side walls thereof define channel section 52, and such that an upper surface plate portion 38 thereof (as viewed in FIG. 1) defines a top of large box 22 for collection of removed staples, as will be further described. Smaller arm 42 is constructed in generally the same manner as larger arm 40. Again, as viewed in FIG. 1, arm 42 is fabricated such that side walls thereof define channel 50, and such that a lower surface plate portion 36 thereof (as viewed in FIG. 1) defines a bottom of small box 28 for collection of removed staples, as will be further described.

Figure 3A:
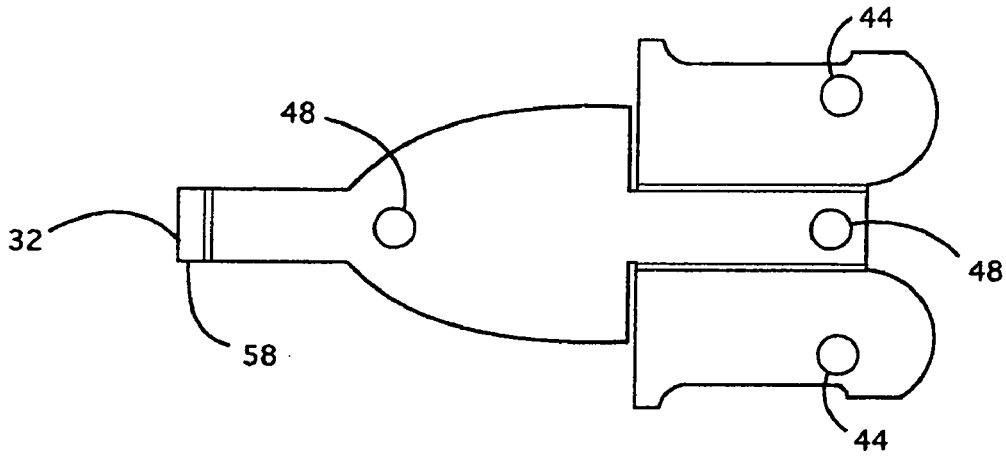
FIG. 3A is a flat metal plate of the smaller arm of the present invention, in its flattened state showing a cutout section.
Figure 3B:
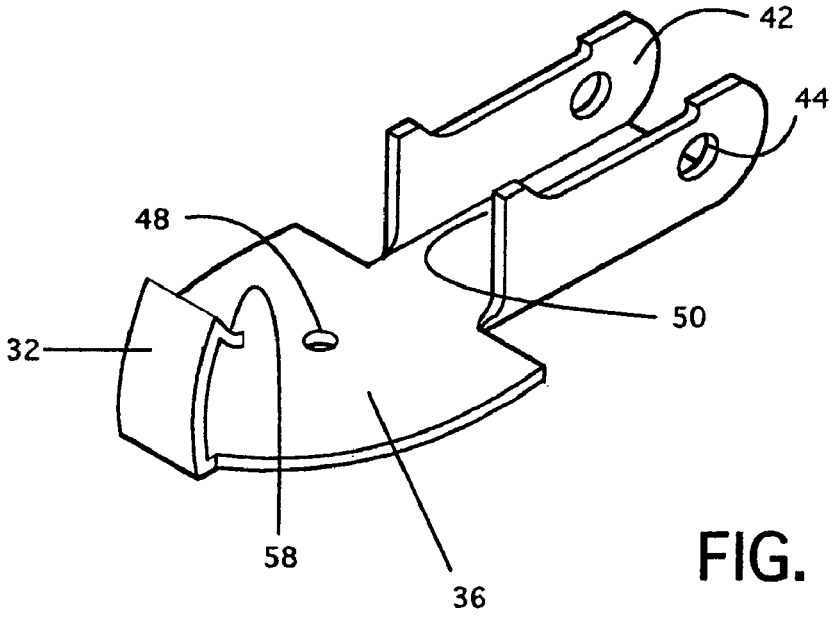
FIG. 3B is the flat metal plate shown in FIG. 3A after it is formed into a channel section, bottom of box area, and prong area.

As viewed in FIGS. 3A and 3B, the typically metal portion of arm 40 may be stamped, rolled or the like into a flat blank from which portions are mechanically removed, and sides are then folded to define channel section 52. Similarly, as viewed in FIGS. 4A and 4B, the typically metal portion of arm may be stamped, rolled or the like into a flat blank from which portions are mechanically removed and sides are folded to define channel section 50. Smaller box 28 is configured to engage and match with large box 22 to form a staple collection area when arms 40 and 42 are pivoted toward one another.

Figure 4A:
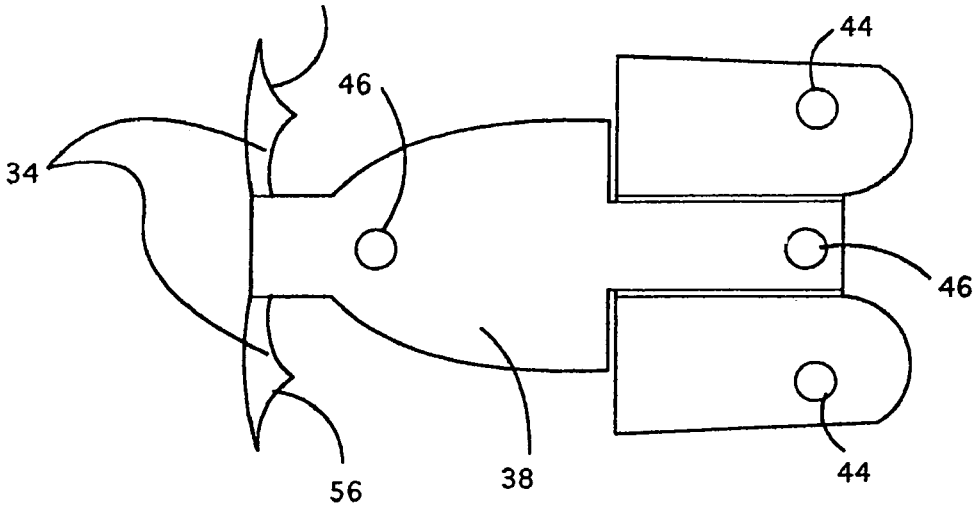
FIG. 4A is a flat metal plate of the larger arm of the present invention, in its flattened state showing a cut out section.
Figure 4B:
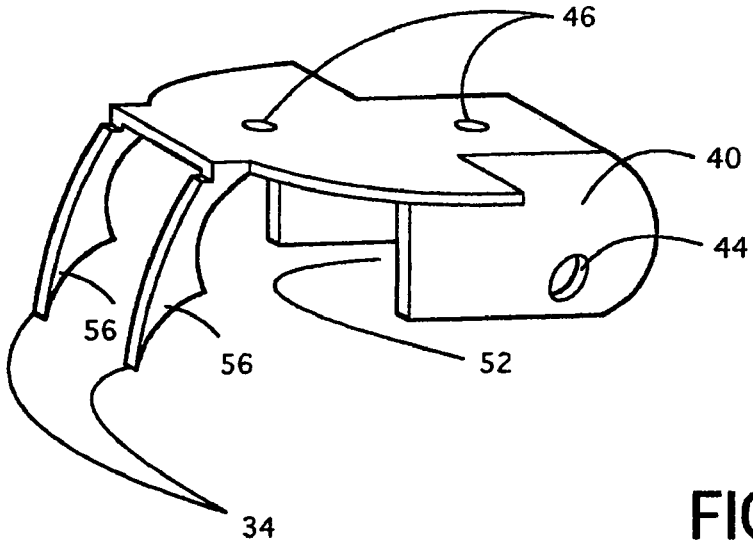
FIG. 4B is the flat metal plate shown in FIG. 4A after it is formed into a channel section, bottom of box area, and prongs area.
Figure 5:
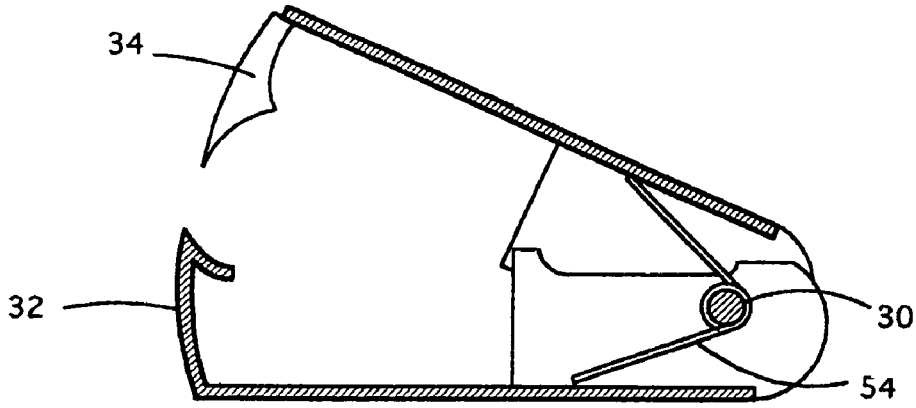
FIG. 5 is a cross-section view of the metallic parts of the invention shown without any associated plastic parts attached thereto.
Figure 6:
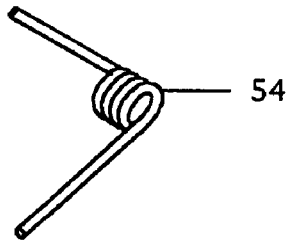
FIG. 6 is a perspective view of a spring that keeps the two arms in an open position.
Figure 7:
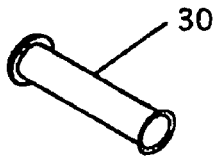
FIG. 7 is a pin/pivot on which the spring and the two arms are mounted.

Larger arm 40 may be attached into large box 22, for example by rivets (not shown) to be located at rivet holes 46 illustrated in FIGS. 4A and 4B. Thumb/finger grip area 20 is attached for example by molding, bonding or the like at an outer surface of arm 40. Similarly, smaller arm 42 is to be attached to small box 28, for example by additional rivets (not shown) to be located at rivet holes 48 illustrated in FIGS. 1, 3A and 3B. Thumb/finger grip area 26 is attached to an outer surface of arm 42 in the same manner as grip area 20, above.

Larger arm 40 thus consists of the housing elements defining channel section 52, large box 22 and dual prongs 34. Smaller arm 42 consists of the housing elements defining channel section 50, small box 28 and the single prong 32 shaped to fit between and positioned to cooperate with dual prongs 34. Arms 40, 42 are associated or interconnected by pin 30 (see FIGS. 5, 7) positioned in pin hole 44. Spring 54 is mounted on pin 30 (FIGS. 5, 6) within the chambers 50 and 52 of the two arms 40 and 42 so as to bias prongs 34 of the larger arm 40 and prong 32 of the smaller arm 42 away from each other in an open position, awaiting use.

Prongs 34 are provided with curved or camming surfaces 56 (see FIGS. 4A, 4B) formed such that each prong 34 widens in a direction away from its working end where it would be inserted beneath a bridge element of a bound staple to be removed. Similarly, single prong 32 also has a curved or camming surface 58 (see FIGS. 3A, 3B) formed to widen in a direction away from its working end where it is to be pressed beneath a bound staple bridge. Importantly, camming surface 58 of single prong 32 is shorter as compared to the longer camming surfaces 56 of prongs 34.

From the working end of prong 32 and the working ends of prongs 34, the camming surfaces 58 and 56, respectively, curve slightly toward the lower and upper surface plate portions 36 and 38 defining box 22. Movement of these camming surfaces 56 and 58 thus serve to lift the bridge of an embedded or bound staple away from its binding position. The relative difference in the length of camming surfaces 58 and 56 results in a crushing of the removed staple and its movement toward and into box 22.

Removably mounted within an upper portion of box 22 through a sidewall thereof, is a magnetic collection chamber including magnetized tray or drawer 24 illustrated (merely as an example) in FIG. 1 in its closed position. Tray or drawer 24 may comprise a magnetized surface or plate integral with, or attached to a closure or door portion. For example, such a closure may conform in shape to a suitable opening at an outer surface of large box 22, and include a cantilevered, generally flat plate extending into an interior space of box 22 in an appropriate way (e.g., above box 28) as not to conflict or bind when the jaws are closed. The plate would be entirely or at least partially magnetized so as to attract and collect withdrawn staples.

The manner of using the magnetic staple remover 10 to remove a staple from papers or other materials such as textiles is generally similar to that of conventional staple removers in present use. To remove a staple from the papers or material to which it is attached, one first grasps the remover 10 on its thumb/finger grip area 20, 26 and aligns prongs 32 and 34 on opposite sides or flanks of a bound staple to be removed.

Next the user manually squeezes the two grip areas 20/26 together, causing the prongs 34 and 32 to slide underneath the staple with their camming surfaces 56, 58 lifting the staple upward. The single prong 32 is constructed in a way that differs considerably from prongs 34. Prong 32 is shaped to be generally centered between the two prongs 34. Camming surface 58 is also somewhat shorter in length compared to camming surfaces 56 as is viewed in FIGS. 1 and 2.

Thus, as prongs 32 and 34 move beneath a bound staple bridge and the bound staple is slightly lifted, the force of single prong 32 is altered from one of pulling the staple over the two camming surfaces 56, to one of pushing the staple toward box 22 and between the two prongs 34. While the removed staple is being pushed and crushed between the two prongs 34, the original staple shape is forcibly modified into a generally U-shaped or V-shaped wire (or other compressed and deformed shape) as it is pressed to a smaller size.

This action overcomes the problems inherent in existing prior art technologies, where staples being removed continue to cling onto staple puller arms or other parts thereof. The removed staple, because of the change in its size and shape, is easily moved toward and into the magnetic collection chamber and onto the magnetic tray/drawer 24 at the bottom of the large box 22.

Located within a magnetic collection chamber, a removable tray or drawer 24 viewed in FIGS. 1 and 2 has at least a slightly and/or partially magnetic surface to attract and contain the removed staple. Loose staples are allowed to collect therein until the user removes drawer or tray 24 from box 22 of the device and empties its contents into a trashcan. Thus, the present invention avoids the problems of prior art devices by successfully removing and trapping the staples, and restrains them against being flung into the surrounding workplace.

Accordingly, it is apparent that the magnetic staple remover 10 of the present invention provides a useful, timesaving device that will help manage the removal of staples in a simple, safe, and cost-effective manner. The invention protects the user by eliminating direct contact with the sharp ends of the staple. The inventive staple remover 10 further protects documents and other materials which are bound by the staple during the staple removal process, and reduces littering of the work space. Moreover, the invention serves to avoid vacuum cleaner mishaps and damage by effectively compressing and containing staples after removal.

While the foregoing description includes a number elements described in detail, these should not be construed in any way as limiting the scope of the invention and the appended claims. Rather, the above description is merely an exemplification of the present invention. Accordingly, the scope of the invention should be determined not by the embodiment(s) illustrated or examples of their use given, but by the appended claims and their legal equivalents.

I claim:

1. A staple remover having a first and a second arm, each with a first working end and a second pivot end, and including a magnetic collection chamber therebetween, said staple remover further characterized by:

said first arm, at a first working end thereof, includes a pair of staple pulling prongs defining a space therebetween;

said second arm having, at the first working end thereof, a single staple pulling prong having a single engaging edge sized to extend across said space between said pair of prongs of said first arm;

each of said pair of prongs on said first arm including a camming surface widening for a camming distance from a tip at said first working end thereof toward a first pivot end thereof;

said single prong on said second arm including a camming surface extending across the single engaging edge widening from a tip of said first working end of said second arm toward a first pivot end of said second arm, and for a camming distance less than the camming distance of said pair of prongs of said first arm;

said first and second arms are mounted at their pivot ends so as to be pivoted toward one another to engage a bound staple for removal thereof;

said prongs of said first and second arm cooperating so as to lift and crush a bound staple and to move crushed staples away from said working ends and toward said magnetic collector element.

2. The staple remover of claim 1 further characterized by:

said first arm including a plate portion defining a top surface of said staple collection chamber;

said second arm including a plate portion defining a bottom surface of said staple collection chamber;

said staple collection chamber includes a magnetized drawer removably positioned therein for removal and disposal of collected staples.

3. The staple remover of claim 1 further characterized by:

said first arm being at least slightly larger than said second arm;

said second arm is configured so as to fit within said first arm when each of said arms is pivoted at said pivot end thereof.

4. The staple remover of claim 2 further characterized by said first arm being at least slightly larger than said second arm;

said second arm is configured so as to fit within said first arm when each of said arms is pivoted at said pivot end thereof.

5. The staple remover of claim 4 wherein said first and second arms are provided with a spring positioned at said pivot ends thereof biasing said arms apart at the working ends thereof.

6. The staple remover of claim 1 further characterized by:

said first arm is configured to define a first channel section therein, interconnecting with said collection chamber;

said second arm is configured to define a second channel section therein, interconnecting with said collection chamber;

said second channel section is smaller than said first channel section so as to fit within said first channel section when said arms are pivoted toward one another.

7. The staple remover as defined in claim 1, further comprising:

said magnetic collection chamber includes a first larger box portion affixed to said first, larger arm;

said magnetic collection chamber includes a second box portion smaller than said first larger box portion, and affixed to said second, smaller arm;

said second box portion is configured to engage and match said first box portion when said arms are pivoted toward one another to form a removed staple containment area.

8. The staple remover defined in claim 7 further defined by:

said first box portion includes an access door to said magnetic collection chamber;

said magnetic collection chamber includes a tray positioned within said first box portion, said tray being at least partially magnetized so as to attract withdrawn staples, and shaped so as to be withdrawn from said first box portion through said access door.

* * * * *